US007244038B2

(12) United States Patent
Fotherby

(10) Patent No.: US 7,244,038 B2
(45) Date of Patent: Jul. 17, 2007

(54) ILLUMINABLE DECORATIVE FLOATING DEVICE

(76) Inventor: Victor M. Fotherby, Box 197, Lyndhurst, ON (CA) K0E 1N0

( * ) Notice: Subject to any disclaimer, the term of this patent is extended or adjusted under 35 U.S.C. 154(b) by 0 days.

(21) Appl. No.: 11/015,418

(22) Filed: Dec. 20, 2004

(65) Prior Publication Data

US 2005/0141214 A1 Jun. 30, 2005

Related U.S. Application Data

(60) Provisional application No. 60/532,739, filed on Dec. 29, 2003.

(51) Int. Cl.
*F21L 4/00* (2006.01)

(52) U.S. Cl. ..... 362/101; 362/122; 362/802

(58) Field of Classification Search ..... 362/101, 362/802, 122
See application file for complete search history.

(56) References Cited

U.S. PATENT DOCUMENTS

| | | | | |
|---|---|---|---|---|
| D37,243 | S | 11/1904 | Helmschmeid | |
| 2,234,903 | A | 3/1941 | Muench | |
| D130,737 | S | 12/1941 | Balk | |
| 2,316,342 | A | 4/1943 | Krieg | |
| D186,082 | S | 9/1959 | Fischett | |
| 3,944,138 | A | 3/1976 | Easton | |
| 4,524,541 | A | 6/1985 | Geiges | |
| D291,255 | S | 8/1987 | Levine | |
| 5,210,525 | A * | 5/1993 | Lennon et al. | 340/604 |
| 5,508,901 | A | 4/1996 | Kuo | |
| D397,575 | S | 9/1998 | Miller | |
| D412,276 | S | 7/1999 | Arslanian | |
| 6,341,874 | B1 * | 1/2002 | Rubin | 362/103 |
| 6,364,501 | B1 * | 4/2002 | Tai | 362/122 |
| 6,416,198 | B1 | 7/2002 | Vanderschuit | |
| 6,669,352 | B2 * | 12/2003 | McKinney | 362/158 |
| 6,776,502 | B2 * | 8/2004 | Hung | 362/158 |
| 6,824,289 | B2 | 11/2004 | Vanderschuit | |
| D499,526 | S | 12/2004 | Albritton et al. | |
| 6,948,841 | B2 * | 9/2005 | Tsai | 362/565 |

OTHER PUBLICATIONS

U.S. TOY Co, Inc. Wholesale Carnival, Decoration & Party Catalog 1993, p. 39: Floating Rose Candle, right, second row from bottom.

* cited by examiner

*Primary Examiner*—Laura Tso
(74) *Attorney, Agent, or Firm*—Dowell & Dowell, P.C.

(57) ABSTRACT

A floatable, illuminable decorative device, usually in the shape of a flower, is made from a light transparent or translucent flexible thermoplastic material. A light emitting diode powered by a micro cell is sealed within the flower. A water activated switch is mounted in the seal so as to activate the light emitting diode when the device is floated on water.

7 Claims, 2 Drawing Sheets

ILLUMINABLE DECORATIVE FLOATING DEVICE

This application claims the benefit of 60/532,739 filed Dec. 29, 2003.

FIELD OF INVENTION

This invention relates to an illuminable decorative device, such as a flower, and more specifically to an illuminable decorative floating flower.

BACKGROUND OF INVENTION AND PRIOR ART

Floating decorative devices, such as flowers and water birds such as ducks, which can be illuminated have been well known for many years. Generally, such floating devices have been in the form of floating wax candles of any selected design. Such candles have limited visual appeal, may represent a serious fire hazard, and have a very limited burning time. Some users may be allergic to either candle smoke or to candle wax. An improved decorative floating device that obviates all or some of the above defects of the prior art has considerable consumer appeal and finds a ready market.

OBJECT OF INVENTION

It is, therefore, an object of the present invention to provide an improved illuminable floating decorative device that substantially overcomes the defects of the prior art, is relatively inexpensive to manufacture and that can remain illuminated for relatively long periods of time.

BRIEF STATEMENT OF INVENTION

By one aspect of the present invention, there is provided an illuminable floatable decorative device comprising:

(a) a decorative, substantially hollow, floatable, light transmittable housing;

(b) a light source contained entirely within said housing;

(c) a power source, contained within said housing, to energize said light source;

(d) means to seal said power source and said light source within said housing; and (e) switch means to control said light source.

DETAILED DESCRIPTION OF PREFERRED EMBODIMENTS

Figure 1:
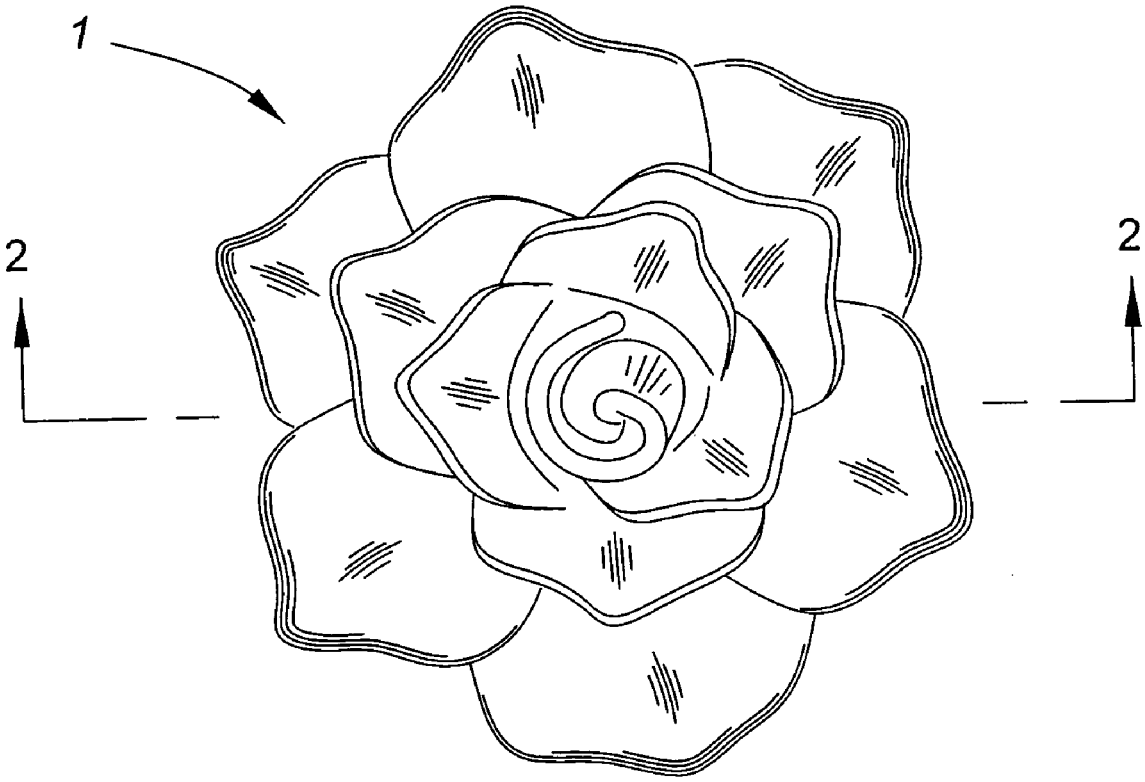
FIG. 1 is a perspective view of one embodiment of the present invention.
Figure 2:
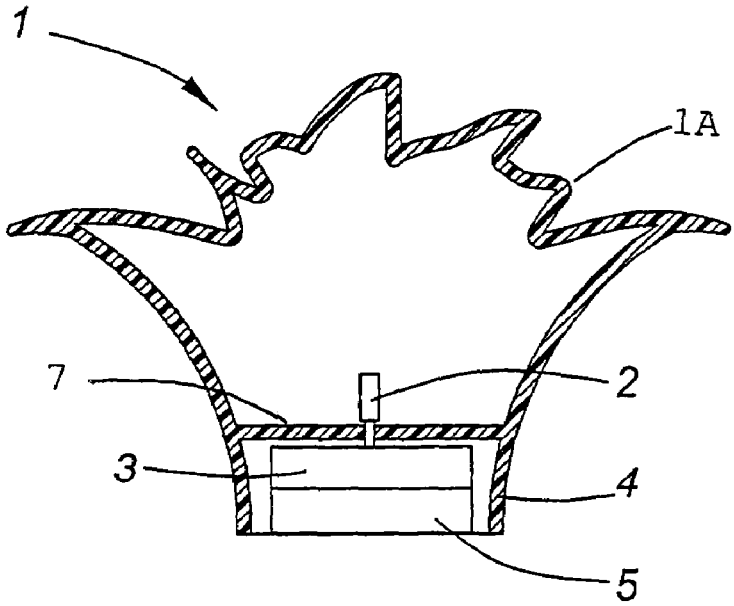
FIG. 2 is a sectional view, taken along line 2—2, of the embodiment of FIG. 1.
Figure 3:
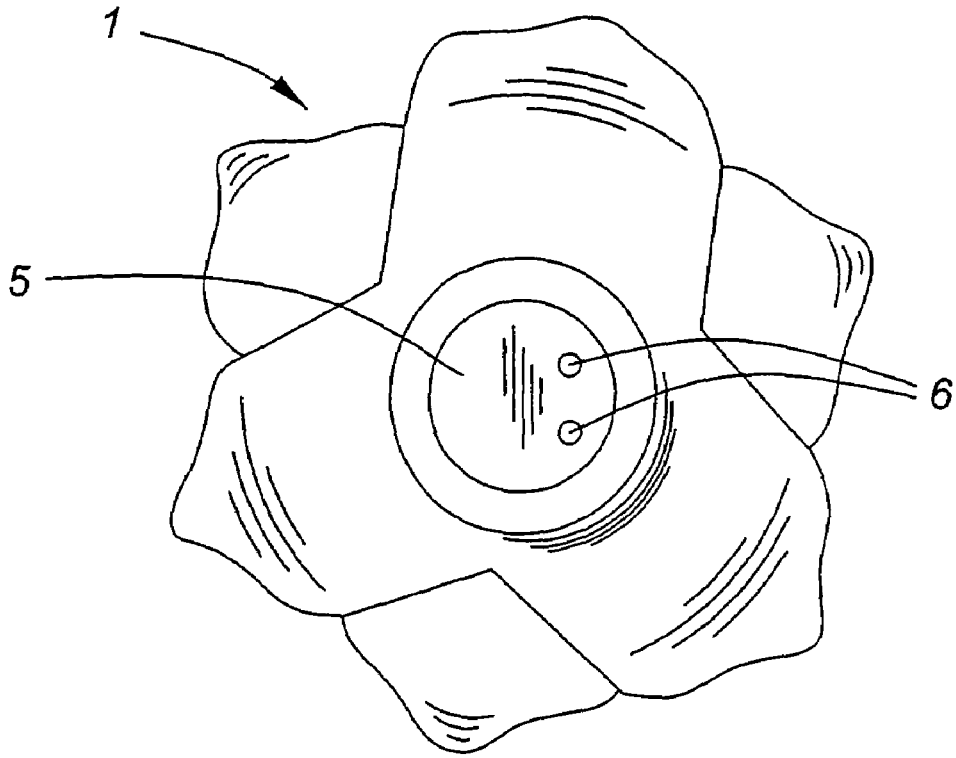
FIG. 3 is a bottom view of the embodiment of FIG. 1.

In FIGS. 1–3 there is shown a preferred embodiment of a floating decorative device in the shape and form of a flower, and more particularly in the shape of a rose. It will, however, be appreciated by those skilled in the art that the exact shape of the device is one of design choice and many other flower shapes, such as water liliest and magnolias, are equally applicable and within the ambit of the present invention. Similarly, many other shapes, such as animal or bird shapes, or purely abstract art forms are also contemplated by the present invention. A decorative body 1 is generally made by injection molding of a flexible, translucent or transparent thermoplastics material, such as high-density polyethylene or polyvinyl chloride. The body 1 includes an upper, decorative portion 1A and a lower body portion 4, which are separated by a divider 7. A multifunctional light, made from one to three or even more high intensity light emitting diode (LED) bulbs 2, is contained within the translucent body 1 and powered by micro cells 3 also contained within the body 1 in the lower housing 4 which is provided with a lower, watertight seal 5. The LED bulbs 2 and the micro cells 3 are completely contained within the lower housing 4 and beneath the divider 7 so as to enhance the decorative effect of the decorative body 1. LED 2 may be programmed to provide a constant, intermittent or fading-in-and-out type of light. The LEDs 2 may be the same or different colors. A control switch 6 controls the ON/OFF function and the functionality of the light. Preferably, but not essentially, the switch 6, as shown in FIG. 3, is a water-activated switch. Other types of switches, such as pressure, motion or sound or light level activated switches are also contemplated. In operation, the decorative body 1 is simply floated on water, usually contained in a suitable container, such as a glass, bowl, or bath, but could equally by a decorative pond, stream, lake or river, and the two contacts 6 of the water-activated switch come into electrical contact with each other through the medium of the water. It will be appreciated that distilled or deionized water may not contain sufficient electrolytes to pass current, but in general, municipal or well water contains sufficient dissolved minerals to ensure electrical contact between the contacts. This completes the electrical circuit, and the micro cells 3 cause the LEDs 2 to illuminate as programmed and remain illuminated until the device 1 is either removed from the water or the micro cells 3 run down.

I claim:

1. An illuminable floatable decorative device comprising:

a substantially hollow, moulded, flexible thermoplastic, floatable, and light transmittable housing for floating on water, said housing having a decorative portion, and a body portion;

a light source contained entirely within said decorative portion, said light source including at least one light emitting diode;

a power source contained entirely within said body portion, to energize said light source, said power source including at least one micro cell;

a means to seal said power source and said light source within said housing; and switch means to control said light source, said switch means is a water activated switch.

2. An illuminable floatable decorative device as claimed in claim 1 wherein said water activated switch is mounted in said seal means.

3. An illuminable floatable decorative device as claimed in claim 2 wherein said housing is a translucent housing.

4. An illuminable floatable decorative device as claimed in claim 2 wherein said housing is a transparent housing.

5. An illuminable floatable decorative device as claimed in claim 1 wherein said decorative portion is in the shape of a flower.

6. An illuminable floatable decorative device as claimed in claim 5 wherein said flower is a rose.

7. An illuminable floatable device comprising:

a light transparent buoyant housing for floating on a liquid surface, said housing having an upper ornamental body portion and lower body portion, the upper ornamental body portion having a decorative surface terminating at an outer periphery, the upper ornamental body portion extending laterally outwardly relative to the lower body portion for presenting the decorative surface above the liquid surface;

a light source contained within said ornamental portion;

a power source, contained entirely within said body portion, to energize said light source;

means to seal said power source and said light source within said housing; and switch means to control said light source.

* * * * *